US005505340A

United States Patent [19]

McBride, Jr.

[11] Patent Number: 5,505,340

[45] Date of Patent: Apr. 9, 1996

[54] APPARATUS FOR DISCHARGING A CONTROLLED QUANTITY OF A HAIR CARE PREPARATION

[76] Inventor: Glenie W. McBride, Jr., G.R.C.C. 180608 B3 417.901 Correction Way, Jarratt, Va. 23870-9614

[21] Appl. No.: 293,045

[22] Filed: Aug. 19, 1994

[51] Int. Cl.[6] ..... B67D 5/52

[52] U.S. Cl. ..... 222/135; 222/181.3; 222/390; 277/165

[58] Field of Search ..... 222/129, 135, 222/180, 181, 386, 390; 277/103, 165

[56] References Cited

U.S. PATENT DOCUMENTS

| | | | |
|---|---|---|---|
| Re. 24,440 | 3/1958 | Groen | 277/165 |
| 3,068,018 | 12/1962 | Tudeman | 277/165 |
| 4,505,405 | 3/1985 | Kelly et al. | 222/135 |
| 5,248,067 | 9/1993 | Garcia | 222/181 |
| 5,356,038 | 10/1994 | Banks | 222/181 X |

FOREIGN PATENT DOCUMENTS

| | | | |
|---|---|---|---|
| 185217 | 7/1955 | Austria | 222/129 |
| 463807 | 8/1928 | Germany | 222/390 |
| 312574 | 11/1933 | Italy | 222/390 |

*Primary Examiner*—Joseph A. Kaufman

[57] ABSTRACT

An apparatus for discharging a controlled quantity of a hair care preparation comprising a flat, generally rectangular wall bracket, a dual dispenser outer housing, the housing being integrally molded and further including at least two identical hollow cylindrical sections for containment of liquid therein, round upper caps, knob members provided on the top of the round caps and positioned in the central portion thereof and being oriented such that the knobs may rotate about the upper cap, threaded dispensing screw rods wherein there is provided a single screw rod extending vertically within each cylindrical section, guide rods being oriented vertically and further being positioned on each side of the central dispensing screw, a square drive being provided about each screw rod, a piston being provided about each screw rod, the piston being movable in a vertical direction within the hollow cylinder about the screw rod, a bottom cap, gravitational hoses in fluid communication with the interior of the cylindrical sections for accommodating the flow of the liquid contents downward and outwardly from within the cylindrical sections, a plurality of hose position retainers provided along the length of the gravitational hoses, and a hollow dispensing nozzle.

4 Claims, 3 Drawing Sheets

FIG. 1
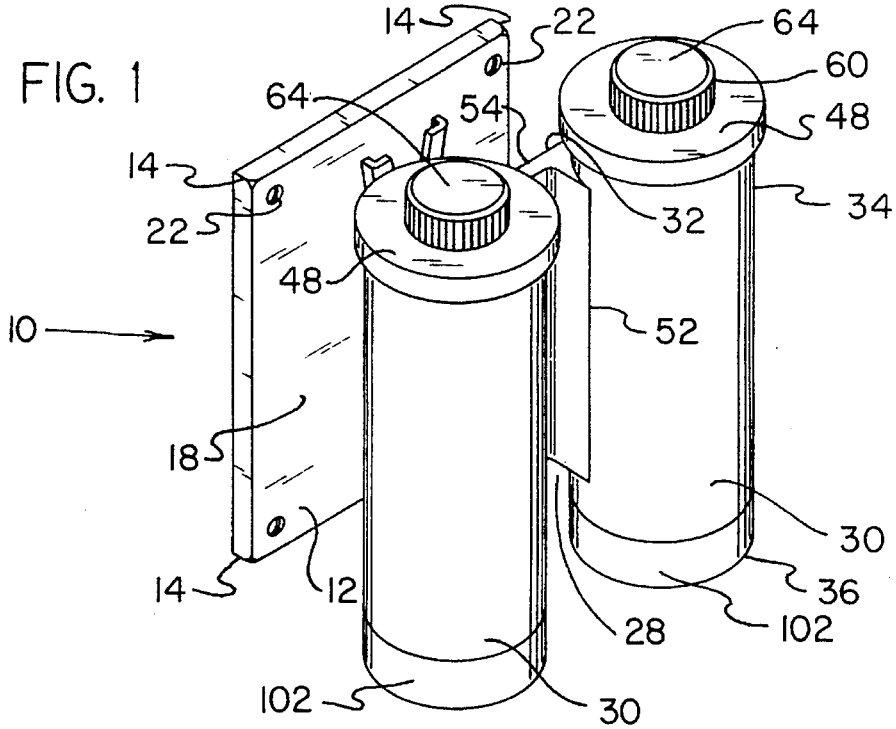
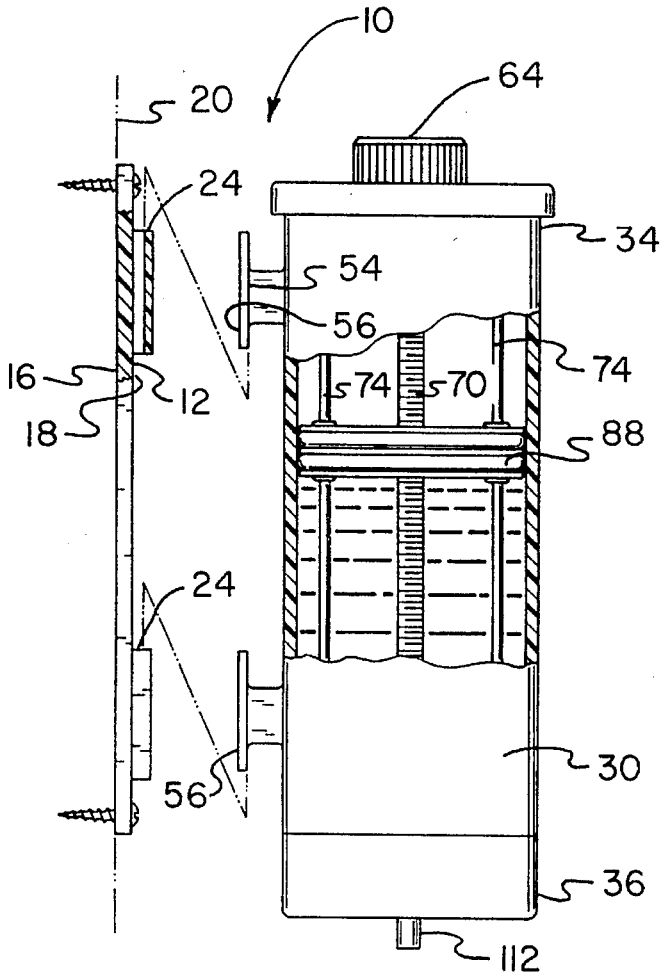
FIG. 2

APPARATUS FOR DISCHARGING A CONTROLLED QUANTITY OF A HAIR CARE PREPARATION

BACKGROUND OF THE INVENTION

1. Field of the Invention

The present invention relates to an apparatus for discharging a controlled quantity of a hair care preparation and more particularly pertains to a dispenser which-operates via gravitational hoses to discharge a controlled portion of shampoo, conditioner, or the like into the user's hand.

2. Description of the Prior Art

The use of shampoo dispensers is known in the prior art. More specifically, shampoo dispensers heretofore devised and utilized for the purpose of dispensing shampoo or the like are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,044,522 to Roig a shampoo dispenser having a plurality of nozzles.

U.S. Pat. No. 3,920,160 to Casale teaches a shampoo dispenser for mounting on a shower stall wall.

U.S. Pat. No. Des. 324,619 to Comstock discloses the design of a multiple dispenser for liquid soap, shampoo, lotion, and the like.

Lastly, U.S. Pat. No. Des. 333,063 discloses the design of a shower dispenser for shampoo.

In this respect, the apparatus for discharging a controlled quantity of a hair care preparation according to the present invention substantially departs from the conventional concepts and designs of the prior art, and in doing so provides an apparatus primarily developed for the purpose of providing a dispenser which operates via gravitational hoses to discharge a controlled portion of shampoo, conditioner, or the like into the user's hand.

Therefore, it can be appreciated that there exists a continuing need for a new and improved apparatus for discharging a controlled quantity of a hair care preparation which operates via gravitational hoses to discharge a controlled portion of shampoo, conditioner, or the like into the user's hand. In this regard, the present invention substantially fulfills this need.

SUMMARY OF THE INVENTION

In view of the foregoing disadvantages inherent in the known types of shampoo dispensers now present in the prior art, the present invention provides an improved apparatus for discharging a controlled quantity of a hair care preparation. As such, the general purpose of the present invention, which will be described subsequently in greater detail, is to provide a new and improved apparatus for discharging a controlled quantity of a hair care preparation and method which has all the advantages of the prior art and none of the disadvantages.

To attain this, the present invention essentially comprises an apparatus for discharging a controlled quantity of a hair care preparation comprising a flat, generally rectangular wall bracket, a dual dispenser outer housing, the housing being integrally molded and further including at least two identical hollow cylindrical sections for containment of liquid therein, round upper caps, knob members provided on the top of the round caps and positioned in the central portion thereof and being oriented such that the knobs may rotate about the upper cap, threaded dispensing screw rods wherein there is provided a single screw rod extending vertically within each cylindrical section, guide rods being oriented vertically and further being positioned on each side of the central dispensing screw, a square drive being provided about each screw rod, a piston being provided about each screw rod, the piston being movable in a vertical direction within the hollow cylinder about the screw rod, a bottom cap, gravitational hoses in fluid communication with the interior of the cylindrical sections for accommodating the flow of the liquid contents downward and outwardly from within the cylindrical sections, a plurality of hose position retainers provided along the length of the gravitational hoses, and a hollow dispensing nozzle.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved apparatus for discharging a controlled quantity of a hair care preparation which has all the advantages of the prior art shampoo dispensers and none of the disadvantages.

It is another object of the present invention to provide a new and improved apparatus for discharging a controlled quantity of a hair care preparation which may be easily and efficiently manufactured and marketed.

It is further object of the present invention to provide a new and improved apparatus for discharging a controlled quantity of a hair care preparation which is of a durable and reliable construction.

An even further object of the present invention is to provide a new and improved apparatus for discharging a controlled quantity of a hair care preparation which is susceptible of a low cost of manufacture with regard to both materials and labor, and which accordingly is then susceptible of low prices of sale to the consuming public, thereby making such apparatus for discharging a controlled quantity of a hair care preparation economically available to the buying public.

Still yet another object of the present invention is to provide a new and improved apparatus for discharging a controlled quantity of a hair care preparation which provides in the apparatuses and methods of the prior art some of the advantages thereof, while simultaneously overcoming some of the disadvantages normally associated therewith.

Even still another object of the present invention is to provide a dispenser which operates via gravitational hoses to discharge a controlled portion of shampoo, conditioner, or the like into the user's hand.

Lastly, it is an object of the present invention to provide a new and improved apparatus for discharging a controlled quantity of hair care preparation comprising a flat, generally rectangular wall bracket, a dual dispenser outer housing, the housing being integrally molded and further including at least two identical hollow cylindrical sections for containment of liquid therein, round upper caps, knob members provided on the top of the round caps and positioned in the central portion thereof and being oriented such that the knobs may rotate about the upper cap, threaded dispensing screw rods wherein there is provided a single screw rod extending vertically within each cylindrical section, guide rods being oriented vertically and further being positioned on each side of the central dispensing screw, a square drive being provided about each screw rod, a piston being provided about each screw rod, the piston being movable in a vertical direction within the hollow cylinder about the screw rod, a bottom cap, gravitational hoses in fluid communication with the interior of the cylindrical sections for accommodating the flow of the liquid contents downward and outwardly from within the cylindrical sections, a plurality of hose position retainers provided along the length of the gravitational hoses, and a hollow dispensing nozzle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the new and improved apparatus for discharging a controlled quantity of a hair care preparation constructed in accordance with the principles of the present invention.

FIG. 2 is side view in partial cross-section showing the mounting attachment of the dispenser to a bathtub or shower wall.

The same reference numerals refer to the same parts through the various Figures.

DESCRIPTION OF THE PREFERRED EMBODIMENT

Figure 3:
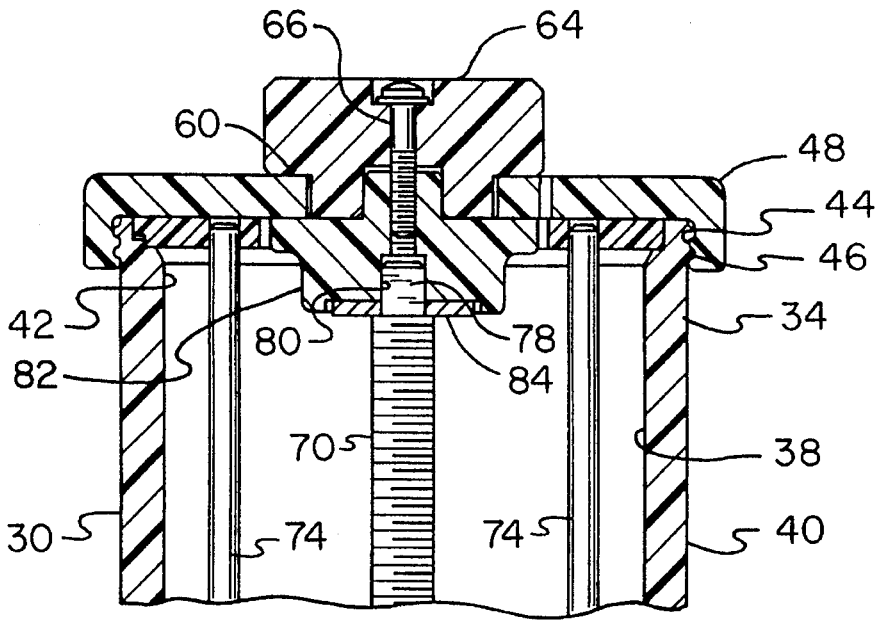
FIG. 3 is a front view in cross-section of the cap and upper section of the apparatus.
Figure 4:
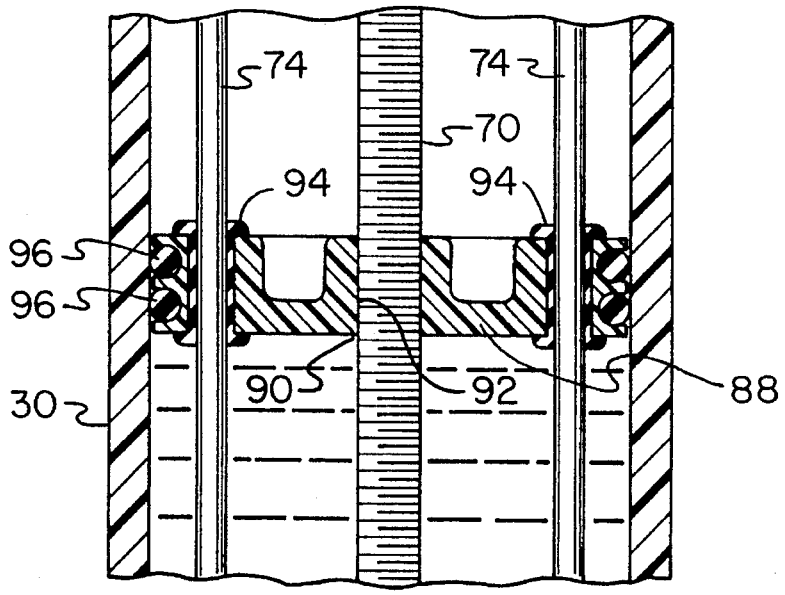
FIG. 4 is a cross sectional view of the central portion of the dispenser.

With reference now to the drawings, and in particular to FIG. 1 thereof, the preferred embodiment of the new and improved apparatus for discharging a controlled quantity of a hair care preparation embodying the principles and concepts of the present invention and generally designated by the reference numeral 10 will be described.

More specifically, it will be noted in the various Figures that there is provided a new and improved apparatus 10 for discharging a controlled quantity of a hair care preparation comprising a flat, generally rectangular wall bracket 12 having four corner portions 14 and a first rectangular face 16 and a second rectangular face 18. The first face is fabricated for positioning in longitudinal juxtaposed orientation with a conventional bathtub or shower wall 20. The bracket further includes at each of the four corner portions, a screw receiving aperture 22, and additionally, on the second face thereof, two key slots 24 are provided in the center of the second face in aligned vertical relationship.

Figure 5:
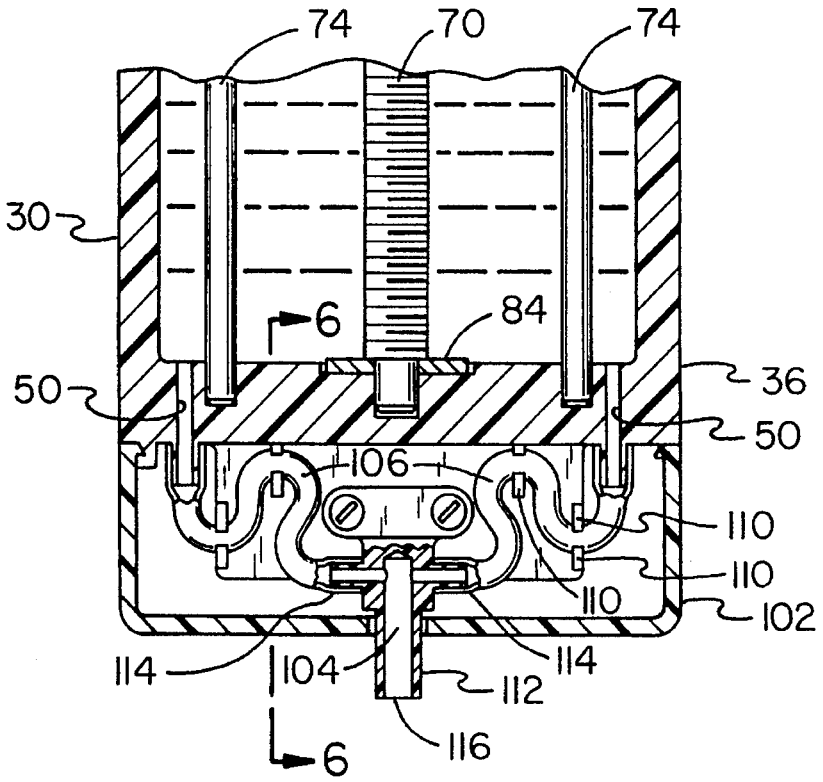
FIG. 5 is a cross sectional view of the bottom portion of the dispenser showing the gravitational hoses and the dispensing nozzle.
Figure 6:
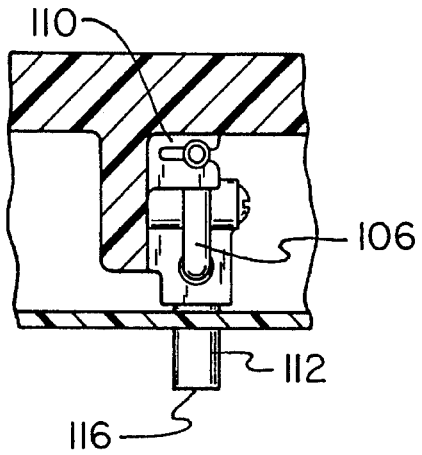
FIG. 6 is a cross sectional view taken along line 6—6 of FIG. 5 showing the dispensing mechanism in particular.

There is additionally included, a dual dispenser outer housing 28, the housing being integrally molded and further including at least two identical hollow cylindrical sections 30 for containment of liquid therein. A joining plate 32 is formed therebetween. The cylindrical sections have a top portion 34 and a bottom portion 36 and an interior 38 and an exterior 40. The top of the cylindrical sections include a filling aperture 42, and further, at the top portion, on the exterior thereof, a series of threads 44, wherein the threads matingly engage the cooresponding threads 46 of a cap. The cylinders further include, at the bottom portion thereof, four identical dispensing apertures 50, two on each section, which allow the liquid therein to flow outwardly therefrom. Note FIG. 5. The joining plate has a front portion 52 and a rear portion 54, and additionally includes two generally square bracket keys 56. The bracket keys are provided on the rear portion of the joining plate and in fixed vertical alignment. The keys are fabricated such that the keys may be slid within the corresponding key slot of the wall bracket to accomplish removable attachment of the housing to the wall bracket.

There are at least two identical round upper caps 48 containing threads 46 which coorespond to the series of threads 44 provided on top of the housing cylinders such that the upper caps may be receivingly fitted and secured thereon. The upper caps 48 further include top and bottom portions and further have a central 60 portion.

At least two knob members 64 are provided on the top of the round caps and positioned in the central portion thereof. The knobs are slip fit within the central portion of the upper caps. The knobs further include a longitudinal central bore 66 formed therein, and the knobs are oriented such that the knobs may rotate about the upper cap.

Two threaded dispensing screw rods 70 are also shown as an essential feature. The screw rod has a top and a bottom, each rod is oriented vertically within one of the hollow cylindrical sections of the housing from the top of the cylinder to the bottom. The rod further extends upwardly, above the cylinder and through the longitudinal central bore of the knob member such that upon rotation of the knob about the upper cap, the threaded screw rod is caused to rotate about its longitudinal axis.

Guide rods 74 are provided within the hollow cylindrical sections. Each cylinder contains two guide rods extending from the top to the bottom of the cylinder. The guide rods are oriented vertically and further are positioned on each side of the central dispensing screw such that each cylinder contains two vertical guide rods, with the threaded screw rod therebetween. The guide rods are held fast within the interior of the cylinder and in stationary relationship therewith.

A square drive 78 is included and formed as an upwardly extending projection of the screw rod 70. It is located within a recess 80 of the knob extension 82. The upper and lower portions of the screw rod are provided with washers 84 about the lower central bore.

A piston 88 is provided about each screw rod and has an exterior and further includes an internally threaded bore 90 therethrough wherein the threads 92 of the piston correspondingly matingly engage the threads of the screw rod. The piston is movable in a vertical direction within the hollow cylinder about the screw rod, and the piston is oriented directly above the liquid contained within the cylinder. Thus, upon movement of the piston in a downward direction, the liquid is forced downwardly within the cylinder and seeps out of the cylinder through the dispensing apertures 50 to tubes as will be later described. Each piston further includes two guide rod seals 94 of resilient construction to provide a sealing arrangement between the piston and guide rods. The piston further includes, about its exterior, two O-ring seals 96 of resilient construction which serve to seal the exterior of the piston with respect to the interior of the cylinder.

A bottom cap 102, which has an upper end and a lower end, is provided about the bottom portion of each cylinder. The bottom cap is constructed to snap fit about the exterior of the bottom of the cylinder. The bottom cap has an aperture 104 in the lower end thereof.

There are gravitational hoses 106 in fluid communication with the interior of the cylindrical sections through apertures 50 for accomodating the flow of the liquid contents downward and outwardly from within the cylindrical sections. Each cylindrical section has two gravitational hoses connected therewith such that each dispensing aperture 50 of the cylinder receivingly accepts a gravitational hose and accordingly attaches thereto. The hoses are of resilient construction and further include a diameter, a length portion, a first cylinder connected end and a second nozzle connecting end. The hoses, upon placement of the cylinders, occupy a space defined between the exterior of the bottom portion of the cylinder section and the lower end of the bottom cap.

To maintain the hose in an operable, nonconstricted orientation, a plurality of hose position retainers 110 are provided along the length of the gravitational hoses. The retainers are of rigid construction and further are adapted to encircle the diameter of the hoses at spaced intervals along the length of the hoses. The retainers further ensure maintenance of the hoses in a fixed orientation when the liquid from the cylindrical sections is flowing therein and thus provide for efficient and unobstructed dispensing of the liquid to a user.

A dispensing nozzle 112 is shown. The nozzle is hollow and of rigid construction. The nozzle further is T-shaped and includes two upper hose connecting ends 114 and a single dispensing end 116. The nozzle is positioned in the defined space between the exterior of the bottom portion of the cylinder section and the lower end of the bottom cap. The dispensing end is adapted for placement within the aperture of the bottom cap such that the dispensing end protrudes out from the bottom cap. The two upper hose connecting ends are adapted to receivingly accept in fluid communication, the nozzle connecting ends of the gravitational hoses.

In use, a person wishing to dispense a quantity of shampoo, conditioner, or other hair or cosmetic preperation would simply turn the knob corresponding to the cylinder of product he or she wished to dispense. In so doing, the piston would be forced downwardly upon the liquid contents of the cylinder. This would cause a quantity of the liquid to flow out from the cylinder, through the dispensing apertures thereof, then through the corresponding gravitational hoses included and finally into the T-shaped nozzle and out into the user's hand. The degree of rotation inflicted on the knob would be directly proportional with the quantity of liquid dispensed. This arrangement thus gives the consumer an easy access to his or her hair products without fumbling with the lids of plastic bottles.

The product is easily refilled by removing the cap and pulling the dispensing screw rod and piston out of the housing cylinder. The appropriate liquid product is then poured into the cylinder through the filling aperture. Cleaning of the apparatus may also be easily accomplished by the same steps of disassembly. Since all of the components of the apparatus are preferably of resinous or plastic fabrication, the entire assembly is easy to clean without fear of rust, scratching, or breakage. By utilizing this arrangement for replacement of used hair care products, the consumer may purchase refills packaged in cardboard or the like, which are environmentally friendly, as opposed to plastic, which is a much more expensive packaging container.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved apparatus for discharging a controlled quantity of a hair care preparation comprising:

A flat, generally rectangular wall bracket having four corner portions and a first rectangular face and a second rectangular face, the first face being fabricated for positioning in longitudinal juxtaposed orientation with a conventional bathtub wall, the bracket further including at each of the four corner portions, a screw receiving aperture, the bracket further including on the second face thereof, two key slots provided in the center of the second face and in aligned vertical relationship;

a dual dispenser outer housing, the housing being integrally molded and further including at least two identical hollow cylindrical sections for containment of liquid therein and a joining plate formed therebetween, the cylindrical sections having a top portion and a bottom portion and an interior and an exterior, the top of the cylindrical sections each including a filling aperture, the cylinders further including at the top portion, on the exterior thereof, a series of threads, the cylinders further including at the bottom portion thereof, two dispensing apertures which allow the liquid therein to flow outwardly therefrom, the joining plate having a front portion and a rear portion, the housing further including two generally square bracket keys, the bracket keys being provided on the rear portion of the joining plate and in fixed vertical alignment, the keys being fabricated such that the keys are slid within the corresponding key slot of the wall bracket to accomplish removable attachment of the housing to the wall bracket;

at least two identical round upper caps containing threads which correspond to the series of threads provided on the top of the housing cylinders such that the upper caps are receivingly fitted and secured thereon, the upper caps further including top and bottom portions and further having a central portion;

at least two knob members provided on the top of the round caps and positioned in the central portion thereof, the knobs being slip fit within the central potion of the upper caps, the knobs further including a longitudinal central bore formed therein, the knobs being oriented such that the knobs rotate about the upper cap;

at least two threaded dispensing screw rods of molded construction, the screw rod having a top and a bottom, each rod being oriented vertically within one of the hollow cylindrical sections of the housing from the top of the cylinder to the bottom, the rod further extending upwardly, above the cylinder and through the longitudinal central bore of the knob member such that upon rotation of the knob about the upper cap, the threaded screw rod is caused to rotate about its longitudinal axis;

guide rods of molded fabrication being provided within the hollow cylindrical sections, each cylinder containing two said guide rods extending from the top to the bottom of the cylinder, said guide rods being oriented vertically and further being positioned on each side of the central dispensing screw such that each cylinder contains two said vertical guide rods with the threaded screw rod therebetween, the guide rods being held fast within the interior of the cylinder and in stationary relationship therewith;

a square drive being provided, formed as an upwardly extending projection of the screw rod and located within a recess of the knob extensions, the upper and lower portions of the screw rod being provided with washers about the lower central bore;

a piston being provided about each screw rod and having an exterior and further having an internally threaded bore therethrough wherein the threads of the piston correspondingly matingly engage the threads of the screw rod, the piston being movable in a vertical direction within the hollow cylinder about the screw rod, the piston being oriented directly above the liquid contained within the cylinder and thus, upon movement of the piston in a downward direction, the liquid is forced downwardly within the cylinder and seeps out of the cylinder through the dispensing apertures, each piston further including two guide rod seals of resilient construction to provide a sealing arrangement between the piston and the guide rods, the piston further including about its exterior, two O-ring seals of resilient construction which serve to seal the exterior of the piston with the interior of the cylinder;

a bottom cap having an upper end and a lower end and further being provided about the bottom portion each cylinder, the bottom cap being constructed to snap fit about the exterior of the bottom of the cylinder, the bottom cap having an aperture in the lower end thereof;

gravitational hoses in fluid communication with the interior of the cylindrical sections for accommodating the flow of the liquid contents downward and outwardly from within the cylindrical sections, each cylindrical section having two said gravitational hoses connected therewith such that each dispensing aperture of the cylinder receivingly accepts a gravitational hose, the hoses being of resilient construction and further including a diameter, a length portion, a first cylinder connecting end and a second nozzle connecting end, the hoses, upon placement on the cylinders, occupying a space defined between the exterior of the bottom portion of the cylinder section and the lower end of the bottom cap;

a plurality of hose position retainers provided along the length of the gravitational hoses, the retainers being of rigid construction and further adapted to encircle the diameter of the hoses at spaced intervals along the length of the hoses, the retainers further ensuring maintenance of the hoses in a fixed orientation when the liquid from the cylindrical sections is flowing therein and thus providing for efficient and unobstructed dispensing of the liquid to a user; and a dispensing nozzle, the nozzle being hollow and of rigid construction, the nozzle further being T-shaped and including two upper hose connecting ends and a single dispensing end, the nozzle being positioned in the defined space between the exterior of the bottom portion of the cylinder section and the lower end of the bottom cap, the dispensing end being adapted for placement within the aperture of the bottom cap such that the dispensing end protrudes out from the bottom cap, the two upper hoses connecting ends being adapted to receivingly accept in fluid communication, the nozzle connecting ends of the gravitational hoses.

2. An apparatus for discharging a controlled quantity of a hair care preparation comprising:

a flat, generally rectangular wall bracket having a first rectangular face and a second rectangular face, the bracket further including screw receiving apertures and two key slots provided in the center of the second face and in aligned vertical relationship;

a dual dispenser outer housing, the housing being integrally molded and further including at least two identical hollow cylindrical sections for containment of liquid therein and a joining plate formed therebetween, the cylindrical sections having a top portion and a bottom portion and an interior and an exterior, the top of the cylindrical sections each including a filling aperture, the cylinders further including at the bottom thereof, two dispensing apertures which allow the liquid therein to flow outwardly therefrom, the joining plate having a front portion and a rear portion, the housing further including two generally square bracket keys, the bracket keys being provided on the rear portion of the joining plate and in fixed vertical alignment, the keys being fabricated such that the keys are slid within the corresponding key slot of the wall bracket to accomplish removable attachment of the housing to the wall bracket;

round upper caps, the upper caps being receivingly fitted and secured about the top portion of the cylindrical sections, the upper caps further including top and bottom portions and further having a central portion;

knob members provided on the top of the round caps and positioned in the central portion thereof, the knobs further including a longitudinal central bore formed therein, and further being oriented such that the knobs rotate about the upper cap;

threaded dispensing screw rods wherein there is provided a single screw within each cylindrical section, each rod being oriented vertically within one of the hollow cylindrical sections of the housing from the top of the cylinder to the bottom, the rod further extending upwardly, above the cylinder and through the longitudinal central bore of the knob member such that upon rotation of the knob about the upper cap, the threaded screw rod is caused to rotate about its longitudinal axis;

guide rods being provided within the hollow cylindrical sections, each cylinder containing two said guide rods extending from the top to the bottom of the cylinder, the guide rods being oriented vertically and further being positioned on each side of the central dispensing screw such that each cylinder contains two said vertical guide rods with the threaded screw rod therebetween;

a square drive being provided formed as an upwardly extending projection of the screw rod and located within a recess of the knob extensions;

a piston being provided about each screw rod and having an exterior and further having an internally threaded bore therethrough wherein the threads of the piston correspondingly matingly engage the threads of the screw rod, the piston being movable in a vertical direction within the hollow cylinder about the screw rod;

a bottom cap having an upper end and a lower end and further being provided about the bottom portion of each cylinder, the bottom cap having an aperture in the lower end thereof;

gravitational hoses in fluid communication with the interior of the cylindrical sections for accommodating the flow of the liquid contents downward and outwardly from within the cylindrical sections, each cylindrical section having two said gravitational hoses connected therewith such that each dispensing aperture of the cylinder receivingly accepts one said gravitational hose, the hoses being of resilient construction and further including a diameter, a length portion, a first cylinder connecting end and a second nozzle connecting end;

a plurality of hose position retainers provided along the length of the gravitational hoses, the retainers being of rigid construction and further adapted to encircle the diameter of the hoses at spaced intervals along the length of the hoses; and a hollow dispensing nozzle, the nozzle further being T-shaped and including two upper hose connecting ends and a single dispensing end, the dispensing end being adapted for placement within the aperture of the bottom cap such that the dispensing end protrudes out from the bottom cap, the two upper hoses connecting ends being adapted to receivingly accept the nozzle connecting ends of the gravitational hoses in fluid communication therewith.

3. The apparatus for discharging a controlled quantity of a hair care preparation of claim 2 wherein, the flat, generally rectangular wall bracket further having four corner portions, the first face being fabricated for positioning in longitudinal juxtaposed orientation with a conventional bathtub wall;

the cylinders of the housing further including at the top portion, on the exterior thereof, a series of threads, wherein the threads matingly engage the upper cap which contains threads which correspond to the series of threads provided on the top of the housing cylinders such that the upper caps are receivingly fitted and secured thereon, and the knobs being slip fit within the central portion of the upper caps.

4. The apparatus for discharging a controlled quantity of a hair care preparation of claim 3 wherein, the screw rods and guide rods, square drive, upper caps, knobs, lower caps, hose retainers, piston and nozzle are of molded construction and the square drive further including an upper portion and a lower portion, the lower portion being provided with a flexible washer about a lower central bore, the washer providing a sealing relationship with the square drive about the screw rod;

the piston being oriented directly above the liquid contained within the cylinder and thus, upon movement of the piston in a downward direction, the liquid is forced downwardly within the cylinder and seeps out of the cylinder through the dispensing apertures, each piston further including two guide rod seals of resilient construction to provide a sealing arrangement between the piston and the guide rods, the piston further including about its exterior, two O-ring seals of resilient construction which serve to seal the exterior of the piston with the interior of the cylinder;

the bottom cap being constructed to snap fit about the exterior of the bottom of the cylinder, and the hoses, hose retainers, and nozzle occupying a space defined between the exterior of the bottom portion of the cylinder section and the lower end of the bottom cap, the hose retainers further ensuring maintenance of the hoses in a fixed orientation when the liquid from the cylindrical sections is flowing therein and thus providing for efficient and unobstructed dispensing of the liquid to a user.

* * * * *